US009297157B2

(12) United States Patent
Wendorff

(10) Patent No.: US 9,297,157 B2
(45) Date of Patent: Mar. 29, 2016

(54) TOILET CLOSET FLANGE SUPPORT KIT

(71) Applicant: Matthew Brian Wendorff, Morris Plains, NJ (US)

(72) Inventor: Matthew Brian Wendorff, Morris Plains, NJ (US)

( * ) Notice: Subject to any disclaimer, the term of this patent is extended or adjusted under 35 U.S.C. 154(b) by 293 days.

(21) Appl. No.: 13/778,878

(22) Filed: Feb. 27, 2013

(65) Prior Publication Data

US 2013/0219603 A1 Aug. 29, 2013

Related U.S. Application Data

(60) Provisional application No. 61/603,857, filed on Feb. 27, 2012.

(51) Int. Cl.
*E03D 11/16* (2006.01)

(52) U.S. Cl.
CPC ..... *E03D 11/16* (2013.01); *Y10T 29/49826* (2015.01)

(58) Field of Classification Search
CPC ... E03D 11/16; F16B 39/24; F16B 2043/008; F16B 43/003; F16B 43/005; F16B 21/09; F16B 21/10
See application file for complete search history.

(56) References Cited

U.S. PATENT DOCUMENTS

| | | | | |
|---|---|---|---|---|
| 1,643,367 | A | 9/1927 | Bergmann et al. | |
| 1,915,007 | A | 6/1933 | Weiss | |
| 2,394,964 | A | 2/1946 | Dick | |
| 3,419,288 | A * | 12/1968 | Logsdon | 285/58 |
| 3,675,248 | A | 7/1972 | Gaj | |
| 4,321,713 | A | 3/1982 | Thompson | |
| RE31,561 | E | 4/1984 | Thompson | |
| 4,780,915 | A | 11/1988 | Cushera | |
| 4,989,278 | A | 2/1991 | Kostorz | |
| 5,377,361 | A | 1/1995 | Piskula | |
| 5,378,356 | A | 1/1995 | Logsdon | |
| 5,501,044 | A | 3/1996 | Janesky | |
| 6,212,709 | B1 | 4/2001 | Newton | |
| 7,013,927 | B2 | 3/2006 | Beaumont | |
| 7,404,689 | B1 | 7/2008 | Poling | |
| D574,931 | S | 8/2008 | Hughes | |
| 7,694,474 | B1 * | 4/2010 | Stahl et al. | 52/232 |
| 7,805,777 | B2 | 10/2010 | Hughes | |
| 8,043,497 | B2 | 10/2011 | Silverstein et al. | |
| 8,099,801 | B2 | 1/2012 | Hughes | |
| 8,196,229 | B1 | 6/2012 | Hickok | |
| 8,281,421 | B2 | 10/2012 | Hughes | |
| 8,342,212 | B2 | 1/2013 | Presby | |
| 8,347,906 | B1 | 1/2013 | Ismert et al. | |
| 2010/0175563 | A1 | 7/2010 | Bizal et al. | |

(Continued)

FOREIGN PATENT DOCUMENTS

| | | |
|---|---|---|
| EP | 2 060 685 A2 | 5/2009 |
| EP | 1 911 904 B1 | 12/2011 |

(Continued)

*Primary Examiner* — Janie Christiansen
(74) *Attorney, Agent, or Firm* — Gearhart Law, LLC

(57) ABSTRACT

This disclosure provides a square closet flange support for overall support of closet flange and toilet bolts and to be used with new construction projects as well as in renovation projects to level, support and determine the final height of the closet flange and to prevent a need of cutting circular forms from floor tiles, hardwood or other floor covering. The square support has a seam that allows it to be snapped into two identical halves for use in renovation projects to enable sliding the support halves under the flange without a need to remove and reinstall an already installed flange.

13 Claims, 5 Drawing Sheets

(56) References Cited

U.S. PATENT DOCUMENTS

| | | | |
|---|---|---|---|
| 2010/0320130 | A1 | 12/2010 | Meyers |
| 2011/0088161 | A1 | 4/2011 | Stimpson |
| 2012/0048070 | A1 | 3/2012 | Richter |
| 2012/0167295 | A1 | 7/2012 | Fima |

FOREIGN PATENT DOCUMENTS

| | | | |
|---|---|---|---|
| EP | 2 466 023 | A1 | 6/2012 |
| GB | 2468676 | A | 9/2010 |

* cited by examiner

TOILET CLOSET FLANGE SUPPORT KIT

PRIORITY

This application claims priority of U.S. provisional application No. 61/603,857 filed on Feb. 27, 2012 the contents of which is incorporated herein by reference in its entirety.

FIELD OF THE INVENTION

The invention relates to plumbing and more particularly the invention relates to fittings and flanges to couple a toilet closet flange and to secure and support the toilet closet flange onto the floor.

BACKGROUND OF THE INVENTION

A closet flange (also called toilet flange or toilet closet flange) is a pipe fitting that mounts a toilet to the floor and connects the toilet to a waste pipe. The closet flange is a connecting interface between the toilet, the floor structure and a wastepipe. The closet flange is mounted on top of the subfloor that is under the final tiling or finished floor surface and the toilet is bolted to the flange. Usually the flange has rectangular holes that allow rectangular headed bolts to slide into. These bolts attach the toilet to the flange and the square heads prevent the bolts from turning when the bolts are tightened down. The current methodology of the installation of toilets provides no support under these bolts and toilet flange, often making it difficult to ensure the stability of the bolt and the toilet flange, especially when installing or removing the toilet bowl at a future date. The flange also has holes that allow long screws to fasten it into the floor structure. The current methodology provides no support when these screws are attached.

When installing a closet flange, the height of the flange is essential. The height of the flange has an effect on the height of the toilet bowl, and toilet's proper connection and relationship to the finished floor. This relationship is essential for the stability of the toilet bowl. The closet flange must be installed either flush with the tiles or up a ¼" to ensure proper installation. A proper installation prevents rocking of the toilet and eliminates pressure placed on the waste pipe which, if installed improperly will create further problems down the road. The height of the flange is also an important factor depending on the type of tiles or other floor covers, such as hardwood, vinyl or stone that are to be used. With thicker tiles for example the flange has to be installed in a higher position than with thinner tiles. For thicker hardwoods the flange must be installed in a higher position than thinner hardwoods.

The current art knows circular closet flange spacers. The primary purpose of these circular spacers is to install them on top of an existing closet flange to raise the height of the flange. Such a system provides no support under the existing closet flange. Accordingly, such circular spacers solve the problem of lifting the flange to the floor level, but these devices overlook other problems in the current art.

Because closet flange is circular an installer has to cut a circular pattern in the tile or other finished floor coverings, such as hardwood, when installing the floor covering around the circular flange. Cutting a circular pattern on the tiles is disproportionally time taking. Additionally loss of material is often experienced as tiles tend to break during the cutting of a circular hole or improper cuts of the finished material cause improper fitting. Often times an installer of the floor material will remove the plumber's bolts and try to slide the tiles or other floor material under the closet flange—creating improper connection of the closet flange to the subfloor. Furthermore, when the toilet is installed, the plumber must spend time removing the grout around the closet flange to properly secure the toilet. Breaking a tile is likely to happen. If the bolts have been removed, the plumber must spend time correcting the installation before setting the toilet bowl in place. A circular closet flange spacer does not bring any solution to this problem.

Moreover, the circular flange spacers can be easily used only in new construction projects where the flange is not yet installed in its place. In renovation projects where the flange is already in place but needs support, the currently existing circular spacers require the installer to remove the closet flange, then install the circular spacer and then reinstall the closet flange again.

Furthermore, as the toilet bowl is attached to the flange with the bolts and not to the floor it is utterly important that the flange has enough support beneath it. A circular spacer does not provide the needed support since its intended purpose is to sit on top of an existing closet flange.

The invention according to this disclosure provides solutions to all the above mentioned flaws of the prior art and others.

European Patent Application number 2060685 provides a mounting plate with a square shape and a recess for a rim in a round drain bowl. This device may partially solve the problem of cutting circular pattern on a tile or finished floor surfaces, but it does not allow any adjustment of the height if the flange. Moreover, this device can be only used with drain bowls having the rim that fits into the recess, and therefore it is not useful for regularly and commonly used closet flanges. The design of the device disclosed does not allow this drain to be adapted to use with a closet flange. Furthermore, the square shape is integral with the design of the drain and therefore it is not a closet flange but a drain. A drain cannot act as a closet flange, even if a closet flange may act as a drain.

U.S. Pat. No. 8,196,229 provides an adjustable floor drain that allows adjustment of a grate of a drain to be raised to the level of new floor. This is not a closet flange, nor does it provide any support to a closet flange.

U.S. Pat. No. 4,780,915 provides a toilet floor flange, where there is a square flange member. However, the flange member is integrated to a sleeve member. This floor flange fails to provide any support for the bolts that attach the toilet bowl. The current methodology of installing closet flanges is the same as shown in this patent. The flange is directly mounted to the subfloor and allows no adjustment in its height (see e.g. FIG. 1 of the patent). Further it places the flange below the allowable height and the toilet must be placed prior to the floor finish and then have the floor finish brought up to the toilet. This is a significant departure and creates more work for the finished floor installer, increasing cost, waste, labor and decreasing productivity. The invention disclosed in U.S. Pat. No. 4,780,915 was developed to solve the problem of cutting a round hole for the waste pipe, and instead cutting a square hole. However, installation of this device would require it to be raised in height leaving no positive support underneath it and creating the same problems that exist in circular closet flange installations. Furthermore, since the device disclosed in this patent is a closet flange, it provides no support for the toilet hold down bolts. In fact, by cutting a square hole in the subfloor creates a greater chance for the toilet hold down bolts to be lost or improperly installed, which again creates additional time and labor requirements to correct the installation.

The invention described in this disclosure solves the above problems and others. The invention according to this discloser reduces labor, increases support to the toilet bowl, decreases damage to the flange and pipes. Furthermore, the device of this invention can be used in new construction projects as well as in reconstruction projects without a need to remove the already installed closet flange before installing the support of this invention.

SUMMARY OF THE INVENTION

It is an object of this invention to provide a square support for a toilet closet flange, the support having four equal sides, a centered hole in middle of the support, support tabs to support toilet bowl attachment bolts and counter sunk holes in each of its four corners to attach the support directly on a subfloor of a tile backer board.

It is a further object of this invention to provide a square support for a toilet closet flange, the support having four equal sides, a centered hole in middle of the support, support tabs to support toilet bowl attachment bolts, and counter sunk holes in each of its four corners, wherein the support has at least two breakable seams on two opposite sides of the square, said seams extending perpendicularly from the sides toward a central point of the centered hole, whereby breaking the seam results in two identical halves of the square support.

It is another object of this invention to provide a square support for a toilet closet flange, wherein the square support has support tabs to support the bolts attaching the toilet bowl on the flange and prevent the bolts to fall down.

It is an object of this invention to provide a support for closet flange.

It is another object of this invention to provide a square support for closet flange.

It is another object of this invention to provide a support for closet flange that is invisible once the toilet bowl has been installed.

It is yet another object of this invention to provide a toilet closet flange support that is compatible with any closet flange.

It is yet another object of this invention to provide a method to install a closet flange, said method comprising the steps of sliding a square support over a waste pipe through a centered hole of the support; attaching the closet flange to the waste pipe; lining the support with the closet flange by lining toilet bowl attachment bolts on the flange with support tabs of square support; attaching the square support on a subfloor or tile backer board; attaching the closet flange to the subfloor or tile backer board through the support; and finalizing flooring by attaching flooring material along the four sides of the support.

It is yet another object of this invention to provide a method to install a toilet bowl without a need of cutting circular patterns of tiles, hardwood or other flooring material around a closet flange.

It is a further object of this invention to provide a square support that can be installed easily on new construction projects as well as on remodeling projects where a closet flange is already installed.

It is another object of this invention to provide a kit comprising one or more square supports, a closet flange and screws or nails for attachment.

It is a further object of this invention to provide a method to attach a closet flange on a subfloor in a renovation project, said method comprising the steps of: breaking the seam of a square support to receive two identical support halves; sliding one support half between the closet flange and the subfloor or backer board; sliding the second support half between the closet flange and the subfloor or backer board and moving the halves so that the halves form a full square and that the toilet bowl attachment bolts align with support tabs; attaching the square support on subfloor; attaching the closet flange to the subfloor through the support; and finalizing flooring by attaching flooring material along the four sides of the support.

It is an even further object of this invention to provide a square support that can easily be snapped to two half squares to be used with remodeling projects.

It is an object of this invention to provide a stackable closet flange support to adjust the height of the closet flange.

It is yet another object of this invention to provide a method to install a closet flange at a desired height with use of square flange supports.

It is a further object of this invention to reduce efforts of multiple trades affecting each other's work.

A further object of this invention is to provide a flange support and a method to use the support to reduce waste, increase productivity, and increase profitability.

DESCRIPTION OF THE PREFERRED EMBODIMENTS

The preferred embodiments of the instant invention are now described referring to FIGS. 1-4.

Figure 1:
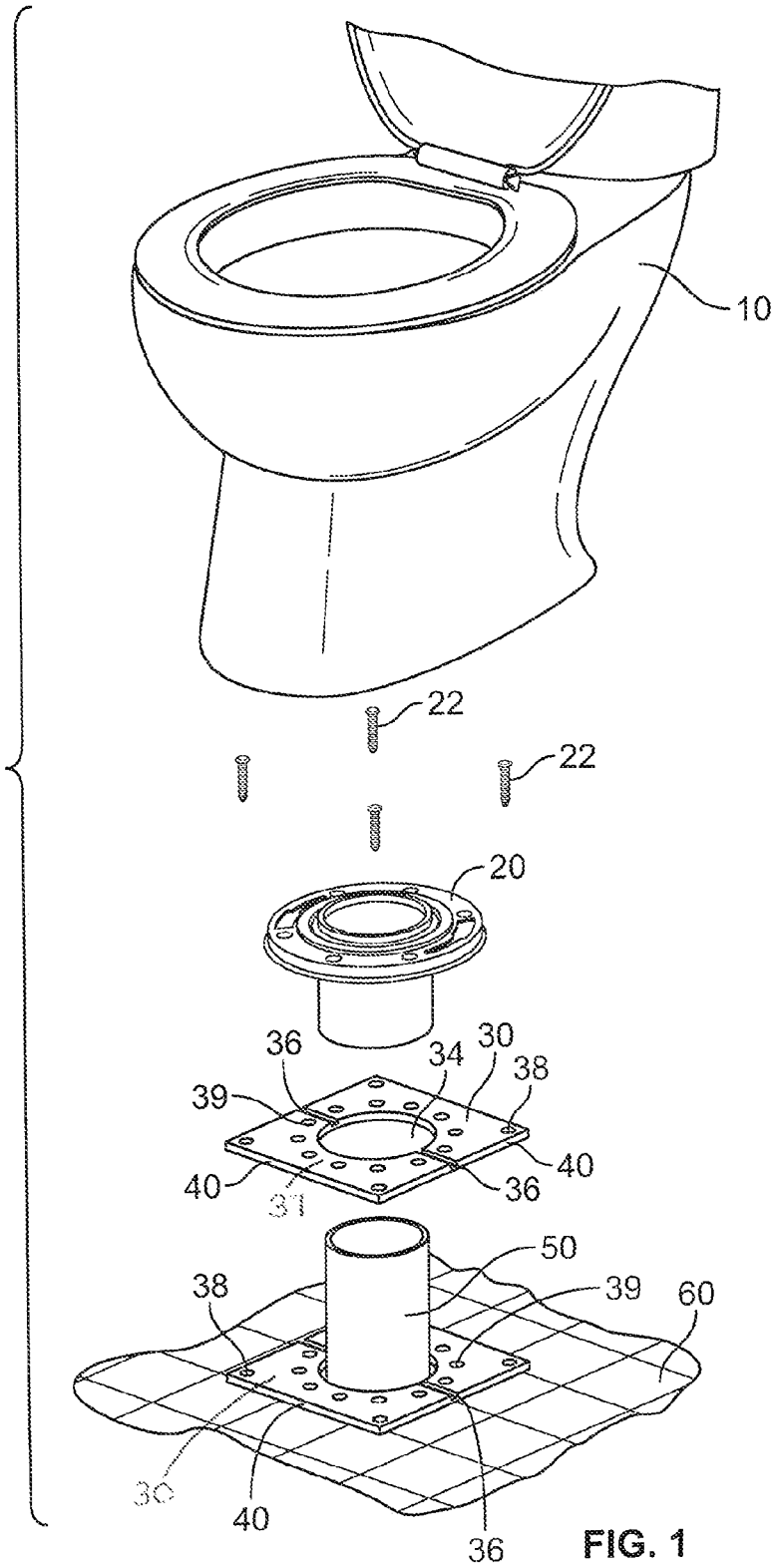
FIG. 1 is an exploded view showing installation of a toilet and toilet flange with a square flange support.

Now referring to FIG. 1. FIG. 1 shows exploded view showing installation of a toilet bowl and toilet flange with a square flange support. The figure shows, a toilet bowl 10; a toilet closet flange 20; two square flange supports 30, a subfloor 60 and a wastepipe 50.

The figure also shows mounting screws 22 to attach the flange 20 to the subfloor 60. The square flange support 30 is shown to have four sides 40 with identical length; a centered hole 34; four attachment holes 38 and a multitude of holes 39 and support tabs 37 around the centered hole 34. Seams 36 for snapping the square into two identical parts is also shown. One support 30 is shown to have been slipped over the wastepipe 50 through a centered hole 34 of the support 30.

Figure 2A:
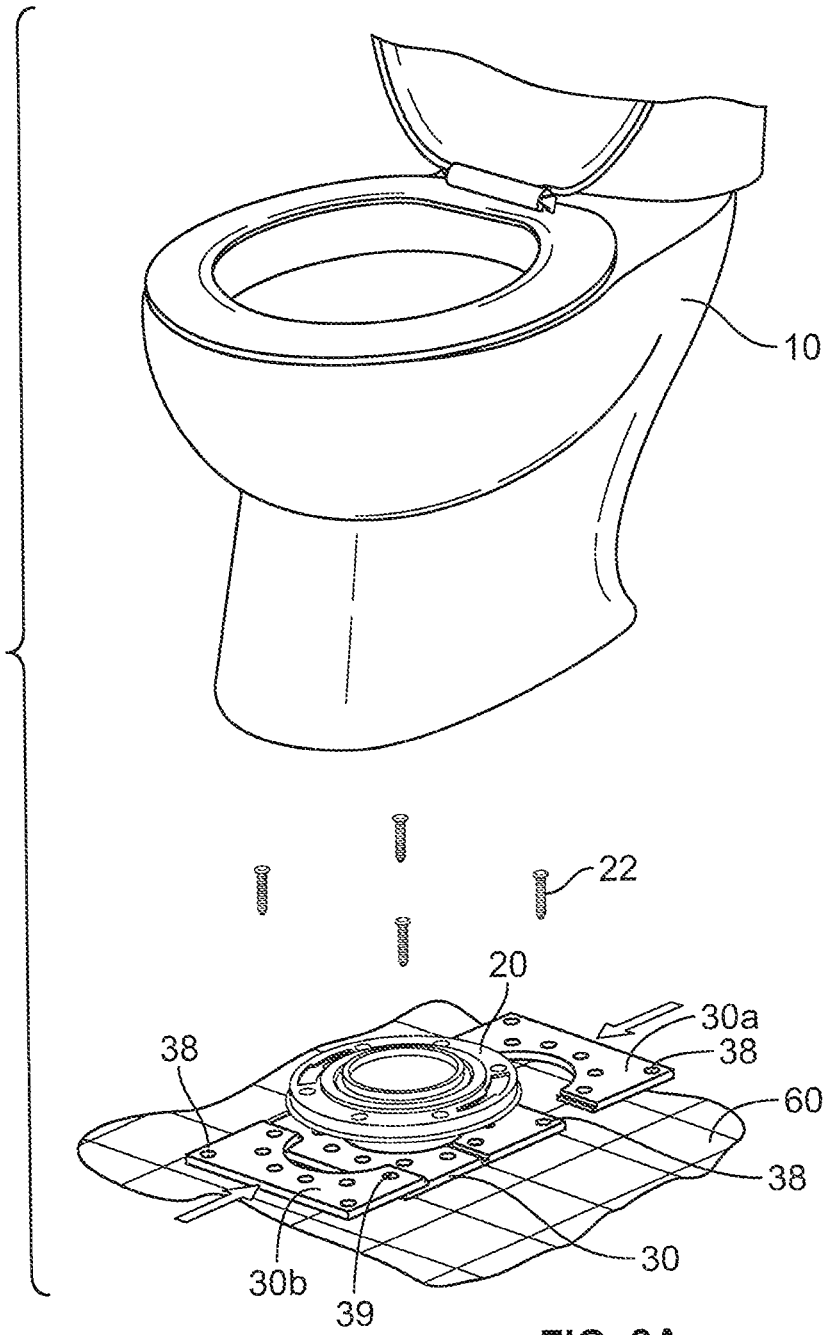
FIG. 2 A is an exploded view showing a renovation project where toilet flange is already installed and the square flange supports are used to support the flange at desired height.
FIG. 2B shows installed toilet flange with two square flange supports supporting the flange.

Now referring to FIG. 2 A. FIG. 2 A is an exploded view showing a renovation project where toilet flange is already installed and the square flange supports are used to support the flange at desired height. FIG. 2A shows a toilet bowl 10, a subfloor 60, a toilet closet flange 20 and mounting screws 22. A square flange support 30 installed under the flange 20. Another square flange support 30 is snapped into to two identical halves 30*a* and 30*b* and the halves are slipped under the flange 20. The arrows show the direction of slipping the support halves 30*a* and 30*b*. The flange support 30 and the flange support halves 30*a* and 30*b* are shown to have counter sunk corner holes 38 for attachment, holes 39 and support tabs 37 around the centered circle 34.

Figure 2B:
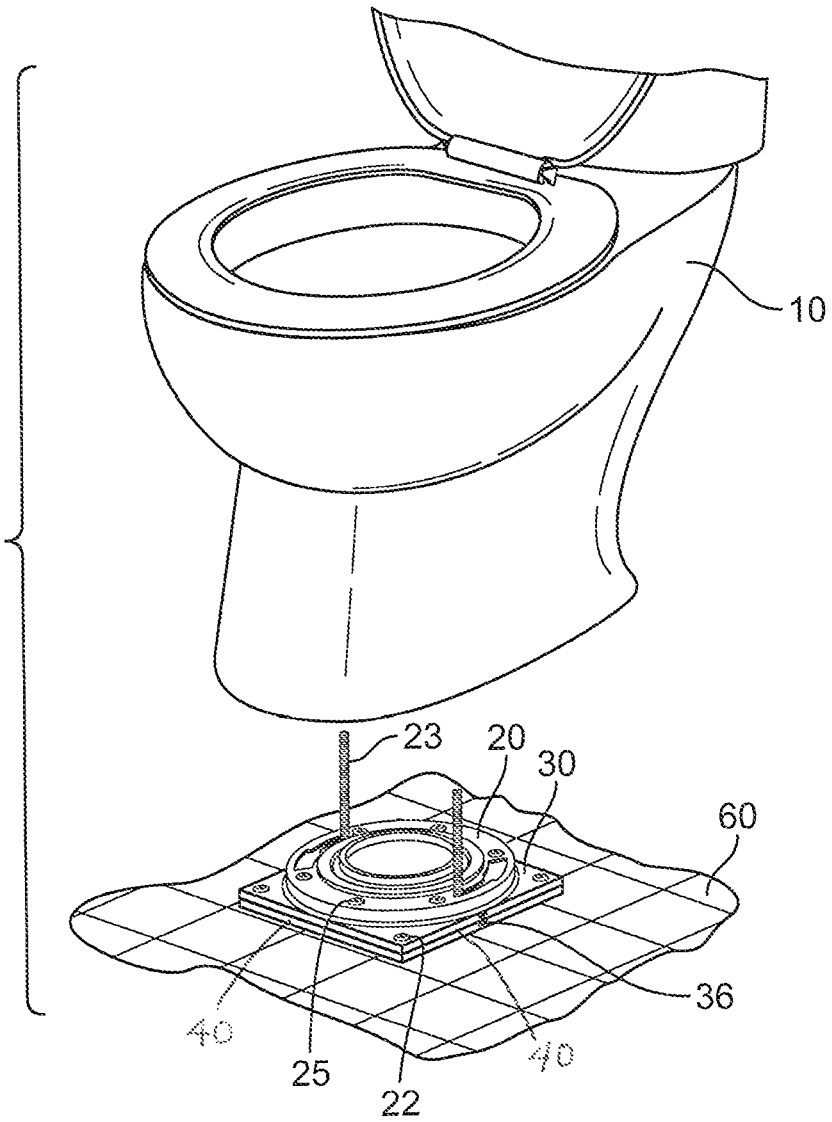

Now referring to FIG. 2B. FIG. 2B shows installed toilet flange with two square flange supports supporting the flange. FIG. 2B shows a toilet bowl 10, and a toilet closet flange 20 attached to the waste pipe 50 (pipe is shown in FIG. 1). The figure shows two square flange supports 30 installed under the flange 20. The square supports 30 are attached to the subfloor 60 with mounting screws 22 through the counter sunk corner holes 38 (shown in FIG. 1). The flange 20 is attached to the subfloor 60 with screws 25. The four identically long sides 40 of the support are shown as well as the seams 36. Bolts 23 to attach the toilet bowl 10 to the flange 20 are also shown.

Figure 3:
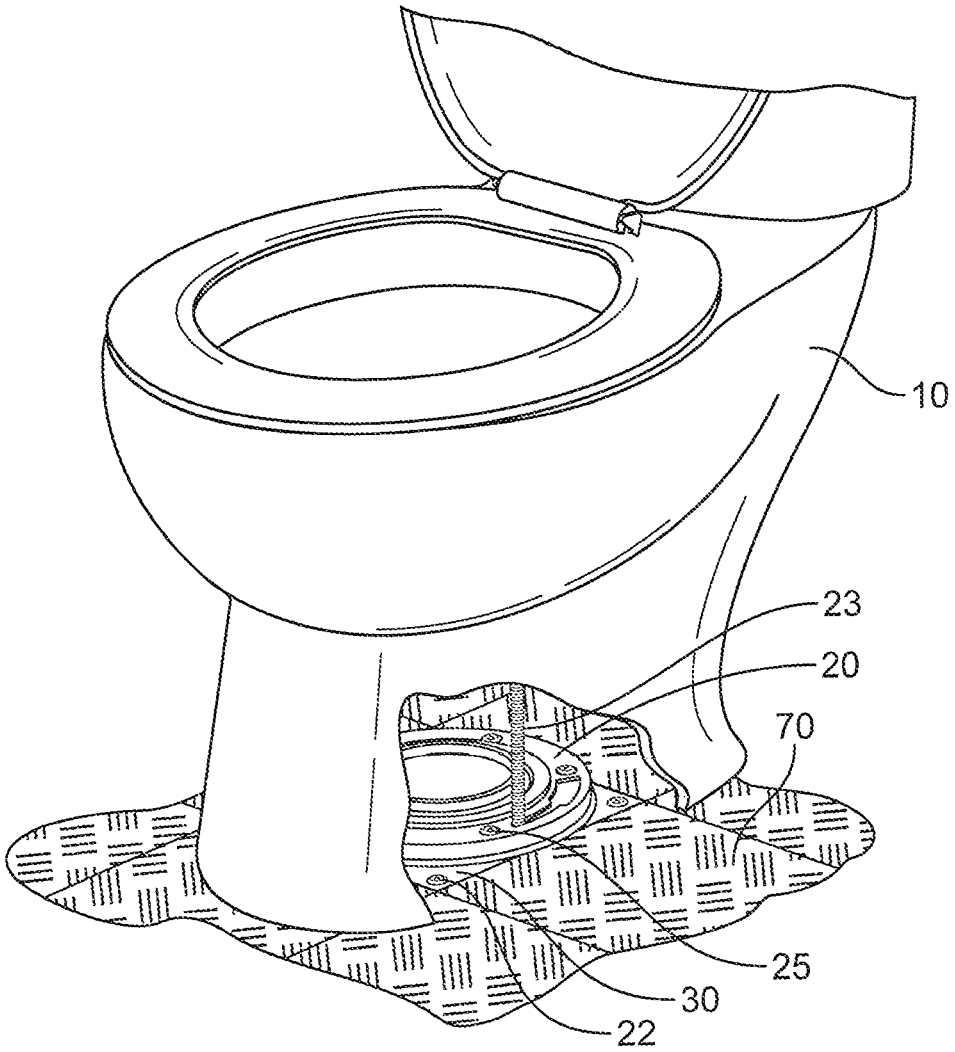
FIG. 3 shows installed toilet flange and final tiling installed along the square flange support's sides.

Now referring to FIG. 3. FIG. 3 shows installed toilet flange and final floor covering installed along the square flange support's sides. The figure shows the toilet bowl 10, the toilet closet flange 20 and the square flange support 30. The flange 20 is attached to the subfloor 60 (shown in FIG. 1) with screws 25 and the support 30 is attached with the mounting screws 22 through the counter sunk corner holes 38 (shown in FIG. 1.). Final floor covering 70 is installed at the level of the support 30. The bolts 23 to attach the toilet bowl 10 to the flange 20 are also shown.

Figure 4A:
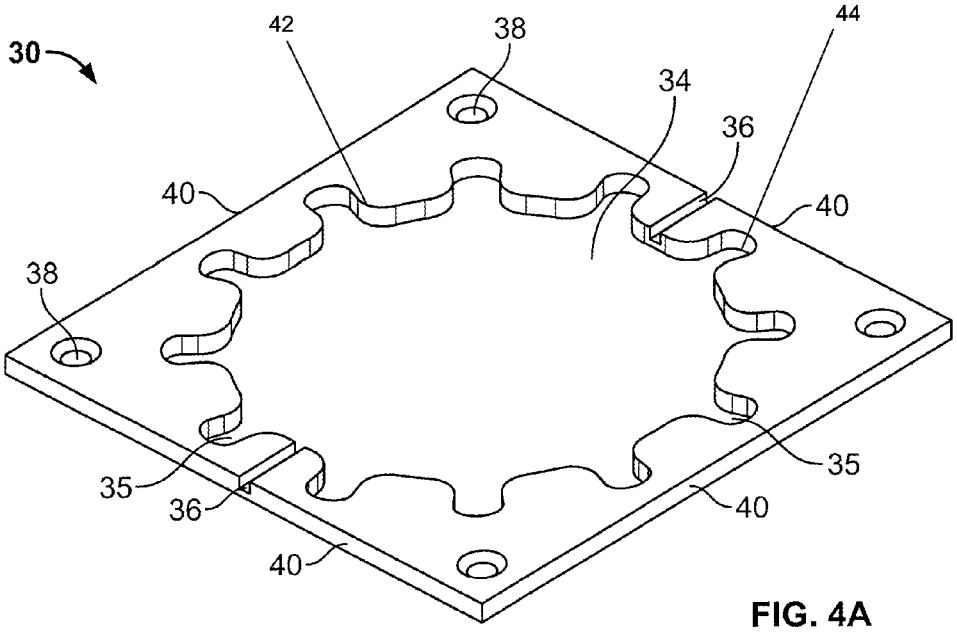
FIGS. 4 A and B show another embodiment of the square flange support. In Figure A the support is in one piece, in FIG. 4B the seam is snapped and the square is in two pieces.
Figure 4B:
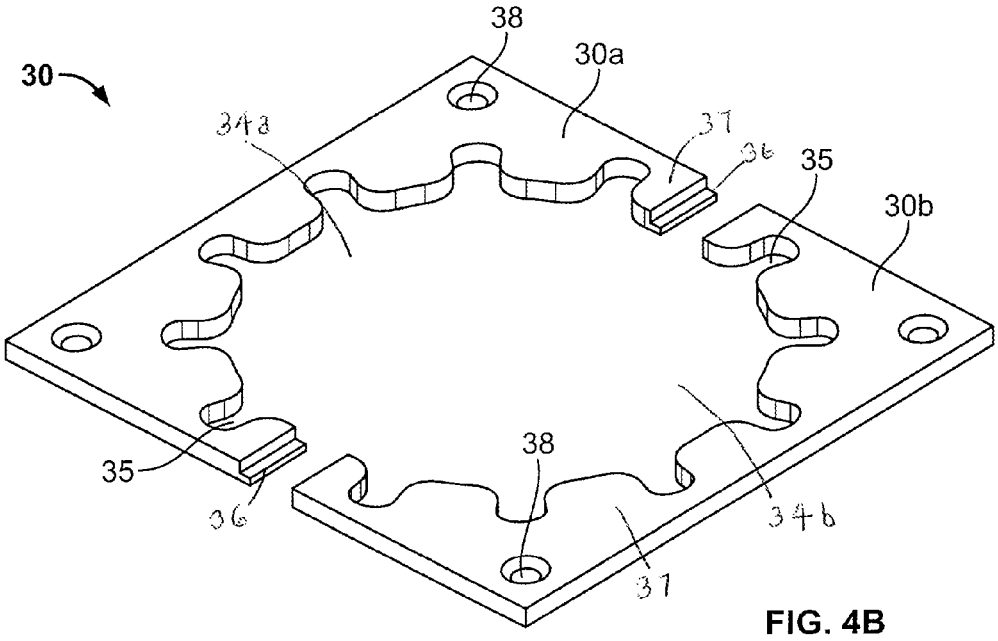

Now referring to FIGS. 4A and 4B. FIGS. 4A and B show another embodiment of the square flange support. FIG. 4A shows four identically long sides 40 of the support 30. The central hole 34 is shown in the figure. The hole has loops 35 along its circle protruding toward the sides 40. The loops 35 have a neck area 42 and a receiving area 44. The neck area 42 is narrower or smaller in diameter than the receiving area 44 as shown in FIG. 4A. The figure shows the counter sunk corner holes 38 and the seams 36 at two sides of the support. The figure also shows the support tabs 37 that are formed in between the loops 35. The support tabs 37 are essential in supporting the bolts 23 (shown in FIG. 2B,3) from falling down and causing destabilization of the installed toilet bowl.

FIG. 4B shows the support 30 in two identical halves 30*a* and 30*b* when the seam 36 has been snapped. The figure shows the center hole halves 34*a* and 34*b*, the loops 35 and the counter sunk corner holes 38. The figure also shows the support tabs 37 that are formed in between the loops 35. The support tabs 37 are essential in supporting the bolts 23 (shown in FIGS. 2B, 3) from falling down and causing destabilization of the installed toilet bowl.

The square support according to this invention is preferably 7-8" times 7-8", most preferably 7" times 7", but other measures may also be used. The square support has a centered hole 34 preferably 5-6" in diameter, most preferably the diameter is 5¼".

The support 30 has counter sunk corner holes 38 for nails or screws in each of its four corners for attachment of the support on the subfloor 60. Alternatively the support may be attached to a tile backer that is on top of the subfloor. Alternatively construction glue or adhesive can be used to attach the square support. Additionally the support has nail or screw holes 39 around the centered hole 34. These nail or screw holes coincide with the holes in the flange and when the flange is attached to the subfloor the nails or screws easily bypass the holes as well. According to one preferred embodiment (shown in FIGS. 4A and B) instead of nail or screw holes around the centered hole 34, the centered hole has multiple loops 35 extending from its circle toward the sides 40 of the square. The loops 35 coincide with the holes in the flange. The loops have such measures that the stem of the screws attaching the flange to the floor bypass the support kit 30. In this embodiment the support tabs 37 are formed in between the loops 35 for supporting the toilet bowl attachments bolts 23 from below.

The square support 30 is preferably ¼" inches thick but may have other thicknesses also. One support or a stack of multiple supports may be used for installing a closet flange. FIG. 2B for example shows use of two supports to provide support for a flange that is installed at about ½" height from the subfloor; i.e. at a height that corresponds with thickness of two ¼"-½" thick supports. When a tile backer is used, it is customary that the backer is about ¼" thick. If the tile is ¼" and the flange is to be installed ¼" above the tile, there is a need for using a stack of three square supports each being ¼" thick. Only one support may as well be used, or any desired number of supports depending on the height at which the flange is to be installed. When more than one support is used in the installation the multitude of the supports is called a stack. A stack of supports may contain any number of supports above one; however a stack two or three supports is most common.

According to one preferred embodiment, the closet flange support 30 is made of plastic, PVC or polypropylene. Other feasible materials may also be used.

According to a preferred embodiment the closet flange support 30 may be made by sawing or cutting the square from plastic into described dimensions. According to another preferred embodiment the support 30 may be molded and injection molding technology may be used. According to yet another embodiment the support may be made by using thermoforming technology.

According to one preferred embodiment the support 30 has at least two breakable seems 36 on two opposite sides of the centered hole 34. Most preferably the support 30 has two breakable seams 36. The two seams 36 extend perpendicularly from two opposite sides 40 toward a central point of the centered hole 34 and the two seams 36 locate in middle of the two opposite sides. When the support 30 is used in a renovation project where the closet flange 20 is already installed in its place (shown in FIG. 2B), the support 30 can be easily snapped into two identical pieces 30*a* and 30*b* along the seams 36. Now the support halves 30*a* and 30*b* can be slid separately between the subfloor 60 (or tile backer) and the closet flange 20 without a need to remove the flange 20. After lining the halves in a way that the support tabs 37 line with the toilet bowl attachment bolts 23 the halves 30 *a* and 30*b* are attached to the floor with screws 22 or nails through the counter sunk corner holes 38 in a way that the two halves again form a complete square on top of which the flange 20 rests. The screws or nails 22 must be set to sit flush or below the surface of the support 30. Again multiple supports can be used in stack or only one support may be used as well. The closet flange 20 is then attached to the subfloor 60 with screws or nails 25 through the holes in the closet flange which coincide with the holes 39 or the loops 35, respectively, in the support halves 30*a*, 30*b*.

In new construction projects the support 30 is used without snapping it into halves. Such situation is shown in FIG. 1. The square support 30 or a stack of multiple supports is placed on the subfloor 60 or tile backer prior to installation of the closet flange 20. Alternatively the support 30 or the stack of multiple supports is slid over the waste pipe 50 through the center hole 34. The closet flange 20 is then glued in its place to the waste pipe 50. The square support 30 or the stack of supports is then lined up in such a way that the support tabs 37 of the support coincide with the bolts 23 of the flange that are used to attach the toilet bowl 10 on the flange 20. This way the support tabs 37 supports the bolts 23 from below and prevents them to fall down. The support 30 is then fastened to the subfloor 60 with nails or screws 22 through the four counter support corner holes 38 in the corners. The closet flange 20 is then attached to the subfloor 60 with screws or nails 25 through the holes in the closet flange which coincide with the holes 39 or the loops 35, respectively, in the support 30, or support halves 30*a*, 30*b*.

According to one preferred embodiment the square support 30 or the stack of supports is attached on the subfloor 60 with glue or construction adhesive instead of nails or screws.

In case of a renovation project where a closet flange 20 is already installed, the support 30 can be snapped into two equal halves 30*a* and 30*b* along the seams 36. Now the support halves 30*a* and 30*b* can be easily slid into place from two sides (shown in FIG. 2A), squared and fastened to the floor similarly as described above.

According to one preferred embodiment a self adhesive water proofing membrane is added to the subfloor prior to the installation of the square support, to better protect the subfloor from potential water damage from an improperly maintained toilet.

Other advantage of this invention is that the square shape and counter sunk holes allow for a greater area of support for a positive reinforcement of the closet flange 20 to the subfloor 60. Whereas in a new construction project, if the hole cut through the subfloor is too large so that all the flange mounting screws 25 cannot connect to the subfloor, the square support 30 provides a greater surface area to screw to the subfloor through holes 38 creating a positive connection to the subfloor.

Whereas in a renovation project if due to rot of the subfloor creating too large of a hole or due to too large of a hole originally cut for the waste pipe so that the flange mounting screws 25 cannot all connect to the subfloor 60 the square support 30 provides a greater surface area to screw the subfloor in through holes 38 creating a positive connection to the subfloor.

Whereas a hard floor installation is used the square shape allow a greater distance from the closet flange creating greater protection of the hard floor if a leak were to occur from the closet flange. The greater distance will provide more time to detect the leak and will minimize moisture transference into hardwood.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A template for surrounding a toilet closet flange, the template comprising:

a template having four sides, wherein each of the four sides has an outer perimeter and an inner perimeter, wherein the outer perimeter defines a square and the inner perimeter defines a central hole configured to surround the toilet closet flange;

at least one breakable seam that traverses at least a portion of the template;

a plurality of loops disposed along and opening toward the inner perimeter, wherein each of the plurality of loops has a neck area and a receiving area, wherein the neck area has a smaller diameter than the receiving area, and wherein the plurality of loops open towards the central hole of the template via the neck area;

support tabs to support toilet bowl attachment bolts, wherein one support tab is disposed between each of the plurality of loops; and at least one hole in each corner of the template.

2. The template of claim 1, wherein the template has two breakable seams on two opposite sides of the template, said seams extending perpendicularly from the sides toward a central point of the central hole and wherein the two seams are located in a middle of the two opposite sides, whereby breaking the seam results in two identical halves of the template.

3. The template of claim 1, wherein the sides are approximately 7 inches, and the central hole has a diameter of approximately 5¼" inches.

4. The template of claim 1, wherein the support has a thickness of approximately ¼ inches.

5. The template of claim 1, wherein the central hole is a circle.

6. The template of claim 5, wherein the support has multiple holes around the centered hole at locations coinciding with attachment holes in the flange and the support tabs are formed in between the holes.

7. The template of claim 1, wherein the template is made of plastic, polypropylene or PVC.

8. The template of claim 1, wherein the template is made by sawing or cutting it from plastic board, by molding or injection molding or by thermoforming technology.

9. The template of claim 1, wherein the template is compatible with any closet flange.

10. A method to install a closet flange, said method comprising the steps of:

a. sliding a template of claim 1 over a waste pipe through the central hole;

b. attaching the closet flange to the waste pipe;

c. aligning the template to with the closet flange by aligning toilet bowl attachment bolts with the support tabs of the template;

d. attaching the template on a subfloor;

e. attaching the closet flange to the subfloor through the template; and f. finalizing flooring by attaching flooring material along the four sides of the template.

11. The method of claim 10, wherein in step a) more than one template is used.

12. A method to attach a closet flange on a subfloor in a renovation project, said method comprising the steps of:

a. breaking the seam of a template of claim 1 to receive two identical template halves;

b. sliding a first template half between the closet flange and a subfloor or a tile backer board;

c. sliding a second template half between the closet flange and the subfloor or the tile backer board and moving the template halves so that the template halves form a full square, wherein toilet bowl attachment bolts line up with the support tabs of the template;

d. supporting each of the toilet bowl attachment bolts with a loop at least two support tabs of the template, wherein the loop and the at least two support tabs prevent the toilet bowl attachment bolts from passing downwards through the template;

e. attaching the template directly to the subfloor or through the tile backer board to the subfloor;

f. attaching the closet flange to the subfloor through the template; and g. finalizing flooring by attaching flooring material along the four sides of the template.

13. The method of claim 12, wherein in step a) more than one template is used.

* * * * *